US007934389B2

(12) United States Patent
Yoon et al.

(10) Patent No.: US 7,934,389 B2
(45) Date of Patent: May 3, 2011

(54) ICE TRAY ASSEMBLY FOR REFRIGERATOR

(75) Inventors: Jong-Seok Yoon, Gyeonggi-Do (KR); Byeong-Gyu Kang, Gyeongsangnam-Do (KR); Jae-Youl Lee, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 337 days.

(21) Appl. No.: 11/769,661

(22) Filed: Jun. 27, 2007

(65) Prior Publication Data

US 2008/0001058 A1 Jan. 3, 2008

(30) Foreign Application Priority Data

Jun. 28, 2006 (KR) ..... 10-2006-0058839

(51) Int. Cl.
*F25C 5/18* (2006.01)
*F25C 1/22* (2006.01)
*B22C 9/20* (2006.01)

(52) U.S. Cl. ..... 62/344; 62/340; 249/119

(58) Field of Classification Search ..... 62/340, 62/344; 249/119
See application file for complete search history.

(56) References Cited

U.S. PATENT DOCUMENTS

| | | | | |
|---|---|---|---|---|
| 3,330,128 | A * | 7/1967 | Wilson | 62/137 |
| 4,265,089 | A * | 5/1981 | Webb | 62/72 |
| 4,649,718 | A * | 3/1987 | Linstromberg et al. | 62/340 |
| 4,762,343 | A * | 8/1988 | Hirohata | 285/140.1 |
| 4,852,359 | A * | 8/1989 | Manzotti | 62/68 |
| 5,012,655 | A * | 5/1991 | Chatterton | 62/340 |
| 5,806,333 | A * | 9/1998 | Kim et al. | 62/353 |
| 5,904,054 | A * | 5/1999 | Lee | 62/347 |
| 6,481,235 | B2 * | 11/2002 | Kwon | 62/353 |
| 6,574,982 | B1 * | 6/2003 | Wiseman et al. | 62/347 |
| 6,612,126 | B2 * | 9/2003 | Kawasumi et al. | 62/347 |
| 7,010,934 | B2 * | 3/2006 | Choi et al. | 62/353 |
| 7,204,092 | B2 * | 4/2007 | Azcarate Castrellon et al. | 62/72 |
| 7,284,392 | B2 * | 10/2007 | Anderson et al. | 62/347 |
| 7,437,885 | B2 * | 10/2008 | Wu et al. | 62/344 |
| 7,487,645 | B2 * | 2/2009 | Sasaki et al. | 62/135 |
| 2007/0012061 | A1 * | 1/2007 | Ribeiro et al. | 62/344 |

FOREIGN PATENT DOCUMENTS

| | | | |
|---|---|---|---|
| CN | 2099944 | U | 3/1992 |
| CN | 1136160 | A | 11/1996 |
| JP | 9-72640 | A | 3/1997 |

* cited by examiner

*Primary Examiner* — Judy J Swann
*Assistant Examiner* — Filip Zec
(74) *Attorney, Agent, or Firm* — Birch, Stewart, Kolasch & Birch, LLP

(57) ABSTRACT

An ice tray assembly for a refrigerator is provided, which includes a case; at least one ice tray disposed in the case; a water box provided at a lateral surface of the ice trays to supply water to the ice trays; and at least one discharge hole provided at the water box corresponding to the number of the ice trays. According to the present invention, the ice tray assembly for the refrigerator is capable of supplying water to the plurality of ice trays at once, of easily supplying water to the ice trays disposed at an upper layer portion in general, as the water box is disposed at the lateral surface of the ice trays, and of uniformly supplying water to each of the plurality of the ice trays.

9 Claims, 10 Drawing Sheets

ICE TRAY ASSEMBLY FOR REFRIGERATOR

CROSS-REFERENCE TO RELATED APPLICATIONS

This application claims priority under 35 U.S.C. §119 to Korean Patent Application No. 2006-0058839, filed in Korea on Jun. 28, 2006, the entirety of which is hereby incorporated by reference.

BACKGROUND

1. Field of the Invention

The present disclosure relates to an ice tray assembly for a refrigerator, and particularly, to an ice tray assembly for a refrigerator which is capable of uniformly supplying water to each of a plurality of ice trays at once.

2. Description of the Related Art

Generally, a refrigerator comprises a refrigerating chamber and a freezing chamber, which are partitioned from each other to store various foods in an appropriate state for a long time. The refrigerating chamber stores various refrigerated foods such as vegetables, fruits or the like, which require storage above freezing temperature, and the freezing chamber stores various frozen foods such as fish or meat, which require storage below freezing temperature.

Also, an ice tray assembly for making ice of a predetermined size by using cool air circulating the freezing chamber is provided therein.

The conventional ice tray assembly for a refrigerator includes a case disposed inside of a freezing chamber and ice trays disposed inside of the case to receive water for making ice. Further, slots into which the ice trays are inserted is provided at the case in order to maintain the ice trays horizontally. Accordingly, if the ice trays containing water are fixed at the slots of the case, ice is obtained by cool air flowing inside the refrigerator.

However, water has to be directly contained in the ice trays by a user in the conventional ice tray assembly for the refrigerator, therefore it is inconvenient that the user has to draw out the ice trays out of the case.

In addition, the user has inconvenience in taking care when fixing the ice trays containing water at the case so as for water not to be overflowed. Particularly the conventional ice tray assembly for the refrigerator is generally disposed at an upper side of the freezing chamber, therefore it is more inconvenient to fix the ice tray containing water for a short person.

Further, water is frequently overflowed in spite of great caring, and then the overflowed water freezes between the case and the ice trays, thereby it is difficult to separate the ice trays from the case.

Further, according to the conventional ice tray assembly for the refrigerator, the ice trays have to be drawn out of the case so as to separate the ice from the ice trays, and there is not additional space for storing the ice separated from the ice trays inside of the refrigerator, accordingly it is ineffective to freeze and store ice.

SUMMARY

The present inventors recognized the drawbacks of the related art described above. Based upon such recognition, the following features have been conceived.

One exemplary feature of the present disclosure is to provide an ice tray assembly for a refrigerator which is capable of supplying water to each of a plurality of ice trays at once.

In addition, the present disclosure provides an ice tray assembly for a refrigerator which is capable of uniformly supplying water to each of a plurality of ice trays.

Further, the present disclosure provides an ice tray assembly for a refrigerator which is capable of selectively separating ice from a plurality of ice trays.

According to the principles of the present disclosure, an ice tray assembly for a refrigerator may comprise: a case; at least one ice tray disposed in the case; a water box provided at a lateral surface of the ice trays to supply water to the ice trays; and at least one discharge hole provided at the water box corresponding to the number of the ice tray.

Herein, preferably the case may be detachably disposed at a door of the refrigerator.

Further, preferably, the water box may be detachably installed at the case.

Further, preferably, the ice trays may be rotatably mounted in the case.

Further, preferably, the ice tray assembly may be further provided with at least one dial coupled to the ice trays to rotate them.

Further, preferably, the discharge holes may be disposed at an upper layer of the ice trays.

Further, the discharge holes may be horizontally extended from the upper layer of the ice trays in parallel with each other.

Further, preferably the water box may be provided with a partition vertically partitioning inside of the water box corresponding to the number of the ice tray.

Further, preferably, the water box may be provided with a plate opening/closing the discharge holes.

Further, preferably, the case may be further provided with a partition wall provided with a waterway partitioning an ice making unit in which the ice trays are mounted and a water supplying unit in which the water box is mounted, and communicating the discharge holes provided at the water box with the upper layer of the ice trays.

Herein, preferably at least one dial may be further provided to penetrate the partition wall for being coupled to the ice trays for rotating them.

Further, preferably, the waterway may be communicated with the discharge holes and downwardly inclined toward the ice trays.

Further, the waterway may be horizontally extended from the upper layer of the ice trays.

Further, preferably the partition wall may be provided with a guide recess to guide the mounted position of the water box so as to communicate the waterway of the partition wall with the discharge holes of the water box.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiment of the invention and together with the description serve to explain the principles of the invention.

In the drawings.

DETAILED DESCRIPTION

Reference will not be made in detail to the preferred embodiments of the present invention, examples of which are illustrated in the accompanying drawings.

Figure 1:
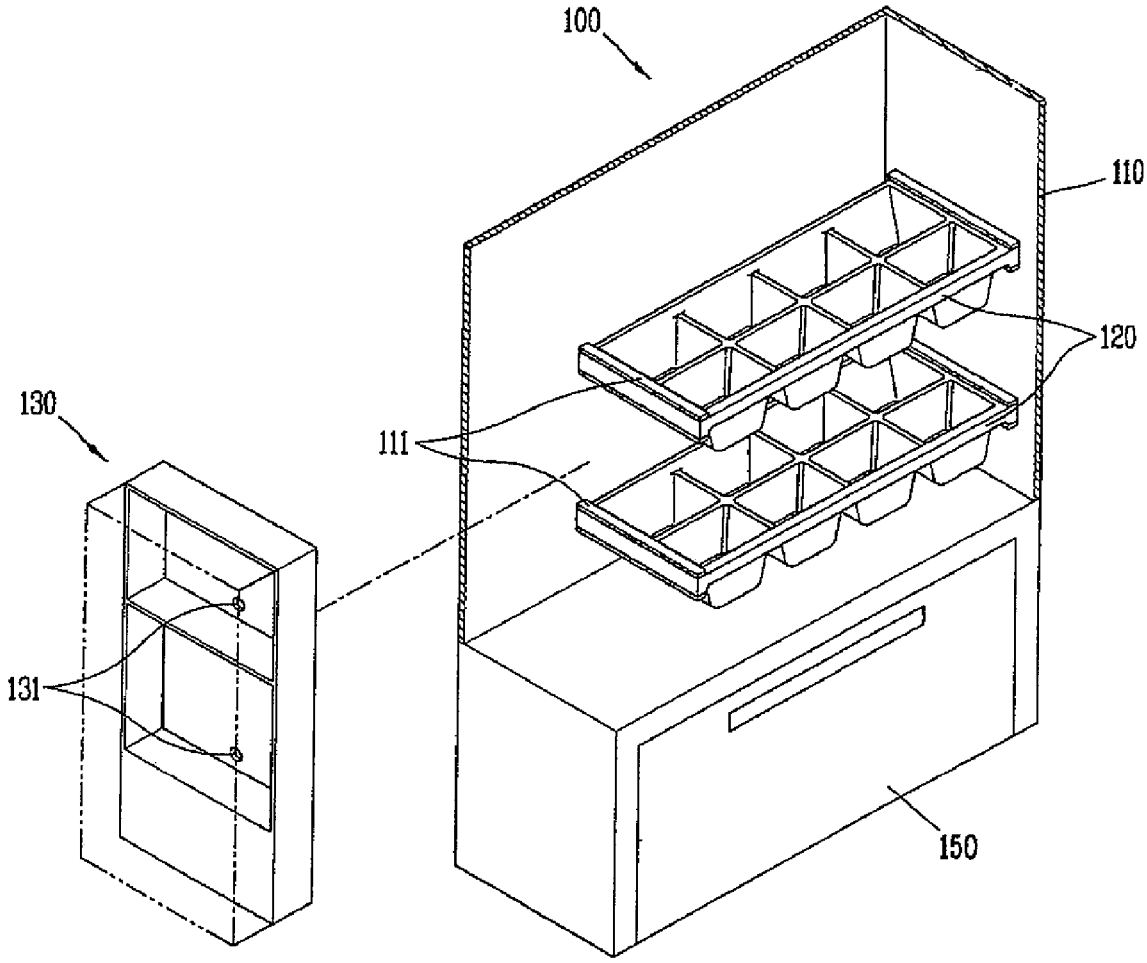
FIG. 1 shows an ice tray assembly for a refrigerator in accordance with a first embodiment of the present invention.

Hereinafter, an ice tray assembly for a refrigerator in accordance with a first embodiment of the present invention will be explained with reference to the accompanying drawings FIG. 1 shows an ice tray assembly for a refrigerator in accordance with a first embodiment of the present invention.

With reference to FIG. 1, the ice tray assembly 100 in accordance with the first embodiment of the present invention may include a case 110, ice trays 120 disposed in the case 110, a water box 130 disposed at a lateral surface of the ice trays 120 to supply water to the ice trays 120 and discharge holes 131 provided at the water box 130 corresponding to the number of the ice tray 120.

Preferably, the case 110 may be a hexahedron shape formed to be is vertically long so as for the ice trays 120 to be multi-staired in a vertical direction.

Accordingly, space for mounting the ice tray assembly for the refrigerator in the refrigerator can be minimized.

However, because the ice trays 120 are multi-staired in the vertical direction, when ice from one of the ice trays 120 drops onto a lower surface of the case 110, the ice may drop to an ice tray 120 located at a relatively lower side. For avoiding this, it is preferable that the upper ice trays 120 are inclined toward a front surface of the case 110.

Meanwhile, preferably, the lower surface of the case 110 may be opened so as for ice dropped from the ice trays 120 to be passed therethrough. Also, an ice storage box 150 for storing the ice supplied from the ice trays may be disposed at the lower side of the case 110, wherein the ice storage box 150 may be a drawer type which is withdrawable toward the front side of the case 110.

The ice trays 120 may be fixed at slots 111 disposed at the case 110, and the front surface of the case 110 may be opened so as to fix the ice trays 120 at the slots 111, preferably.

A water box 130 may be disposed at a lateral surface of the case 110 to supply water to the ice trays 120 multi-staired in the vertical direction through discharge holes 131 provided at the water box 130.

Figure 2:
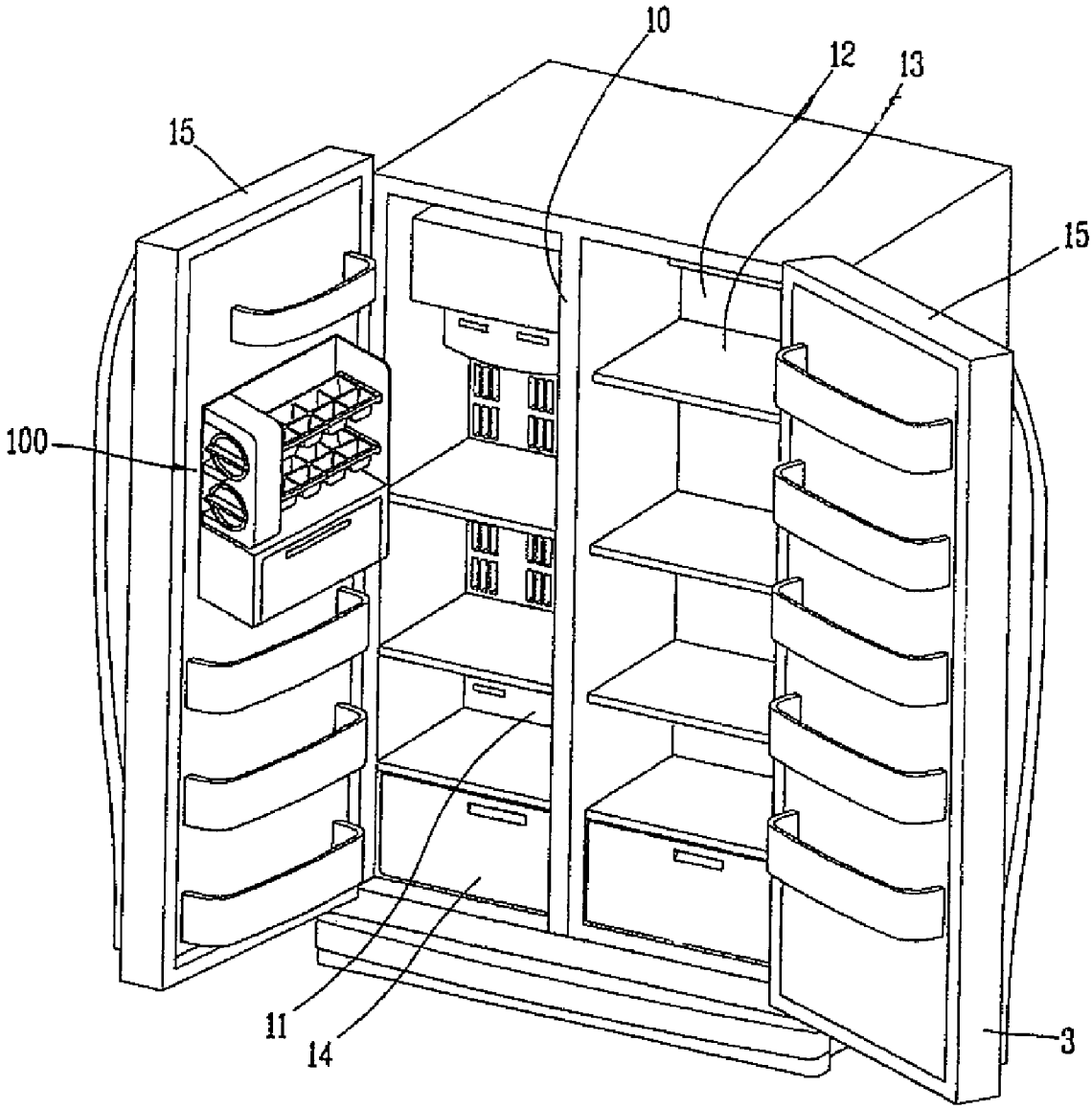
FIG. 2 shows a refrigerator in which the ice tray assembly for a refrigerator in accordance with the first embodiment of the present invention.

FIG. 2 shows a refrigerator in which an ice tray assembly for a refrigerator in accordance with the first embodiment of the present invention. A side by side type refrigerator is illustrated herein for description, it is not limited thereto, but applicable to various kinds of refrigerators.

With reference to FIG. 2, a general side by side type refrigerator may have a freezing chamber 11 and a refrigerating chamber 12 separated by a partition wall 10 vertically formed at an internal center of the refrigerator. And a plurality of shelves 13 and a plurality of drawer type storage compartments 14 may be provided inside of the freezing chamber 11 and the refrigerating chamber 12 so as to store foods requiring storage at a lower temperature.

Herein, preferably, the ice tray assembly for the refrigerator 100 in accordance with the first embodiment of the present invention may be installed at a door 15 of the refrigerator. Herein, the ice trays are multi-staired in the vertical direction. Accordingly, waste of storage space, which is a drawback of the conventional refrigerator having the ice tray assembly in a freezing space can be enhanced.

Figure 3:
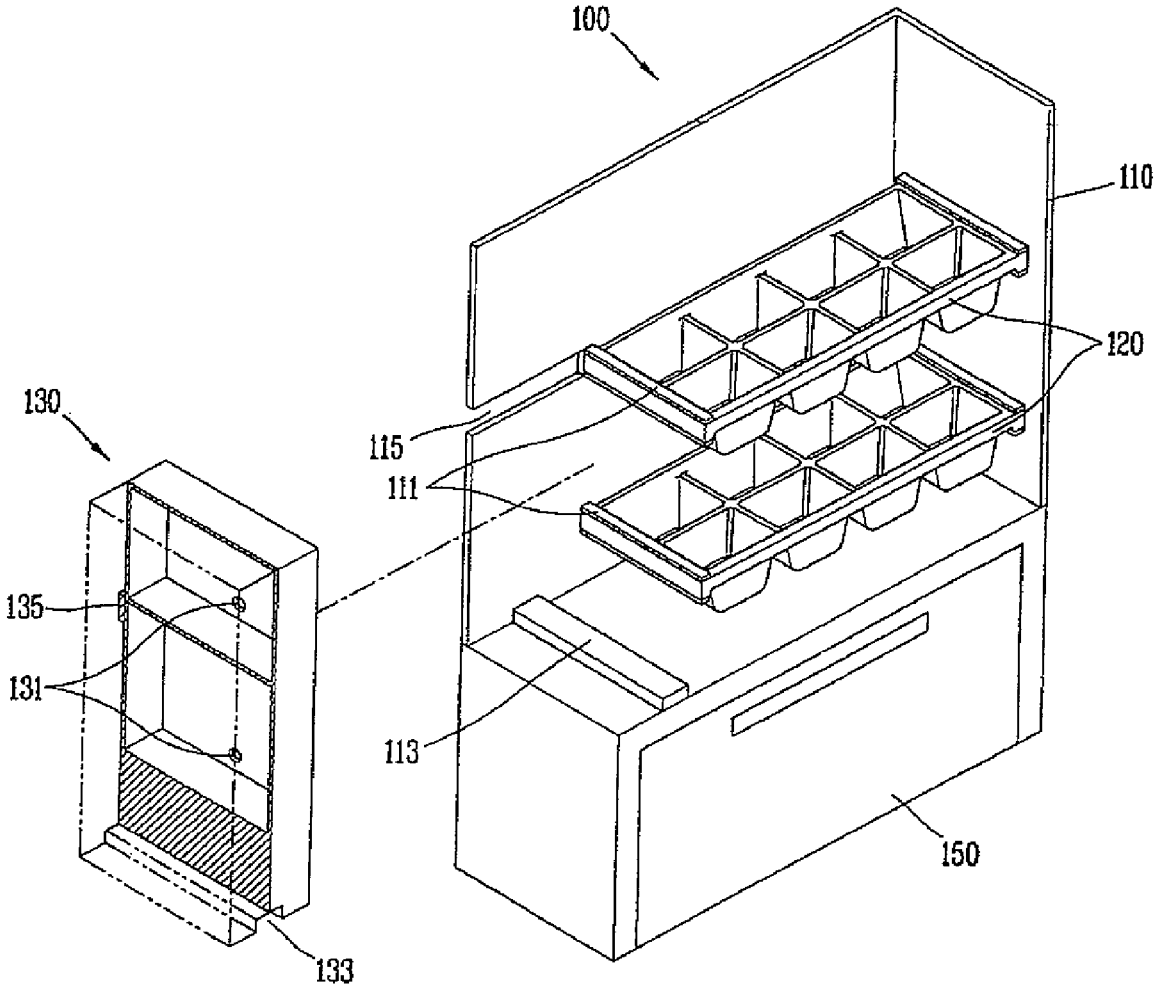
FIG. 3 shows an example that a water box is fixed at a case in FIG. 1.
Figure 4:
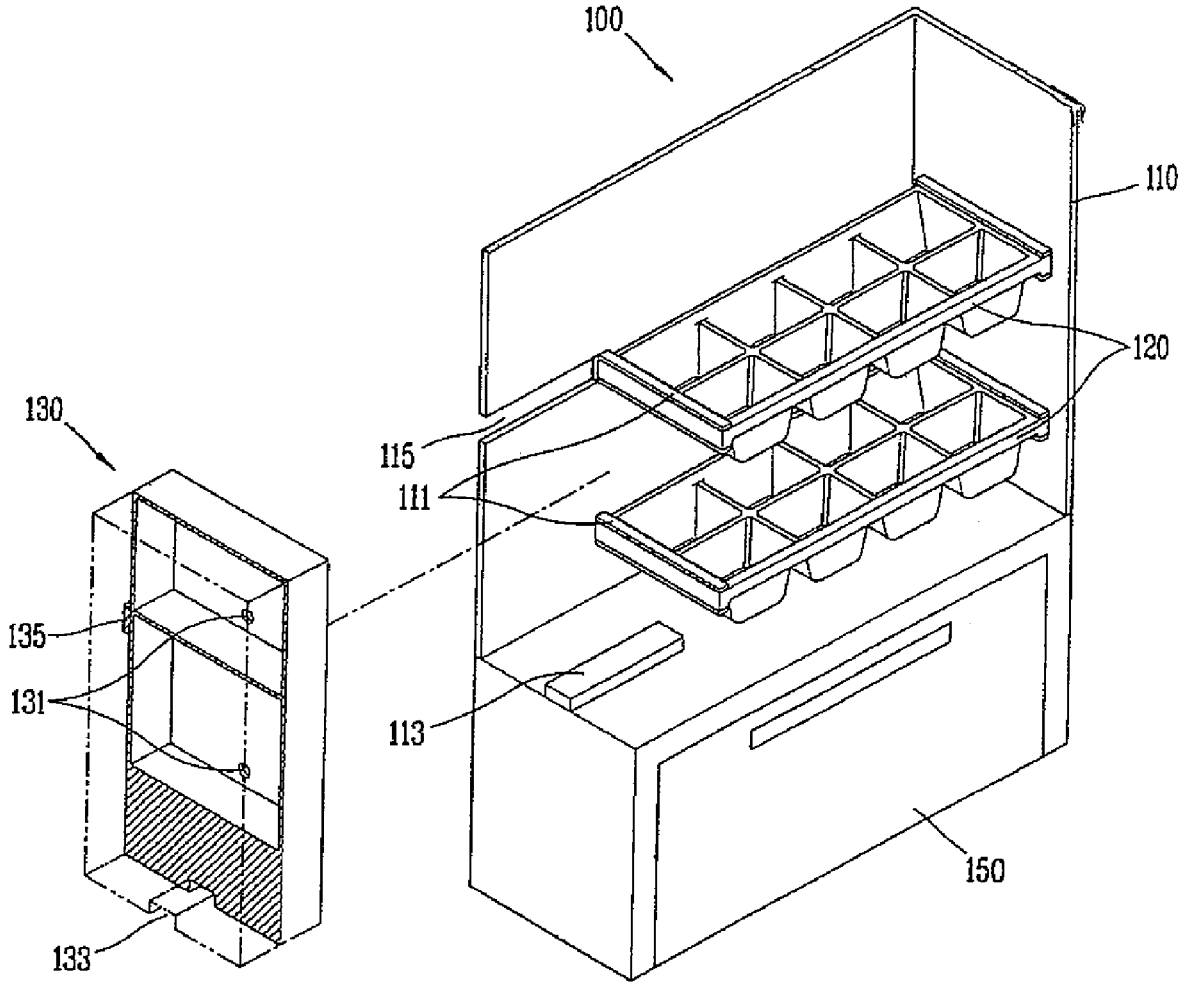
FIG. 4 shows another example that the water box is fixed at the case in FIG. 1.

FIGS. 3 and 4 show examples that a water box is fixed at a case in FIG. 1.

First, with reference to FIG. 3, a guide protrusion 113 may be formed from a front surface toward a rear surface of the case 110 and a guide recess 115 may be provided at the rear surface of the case 110, so as for the water box 130 to be coupled to the case 110. In addition, corresponding to thereabove, a guide recess 133 may be provided at a lower surface of the water box 130 and a guide protrusion 135 may be provided at the rear surface thereof. Accordingly, the water box 130 may be moved from the front surface toward the rear surface of the case 110 to be coupled to the case 110.

With reference to FIG. 4, the guide protrusion 113 may be formed from a lateral surface of the case 110 toward the ice tray 120 and the guide recess 115 may be provided at the rear surface of the case 1101 so as for the case 110 to be coupled to the water box 130. In addition, corresponding to thereabove, the guide recess 133 may be provided at the lower surface of the water box 130 and the guide protrusion 135 may be provided at the rear surface thereof. Accordingly, the water box 130 may be moved from the lateral surface of the case 110 toward the ice trays 120 to be coupled to the case 110.

Figure 5:
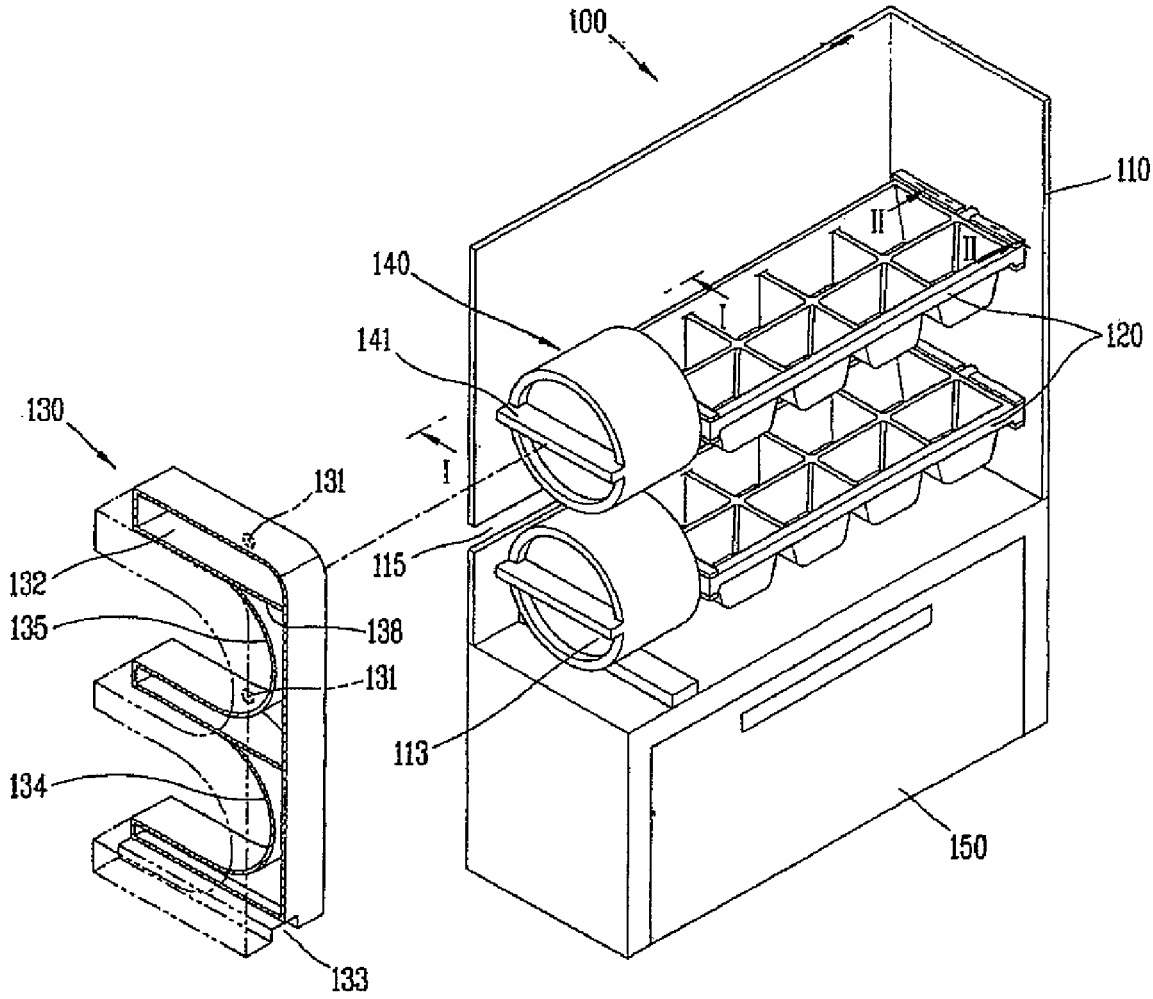
FIG. 5 shows an ice tray assembly for a refrigerator which is provided with dials rotating ice trays in FIG. 1.
Figure 6:
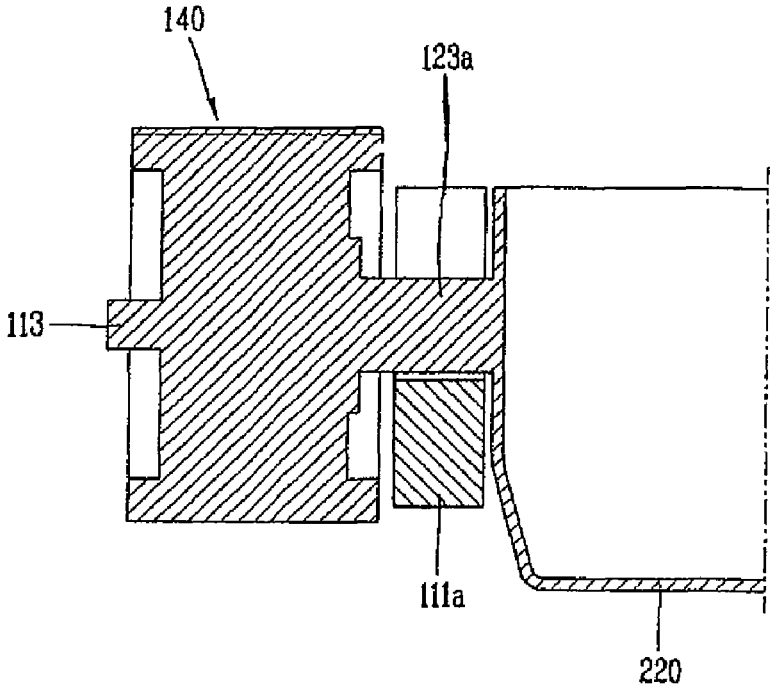
FIG. 6 shows a section taken along the line I-I in FIG. 5.
Figure 7:
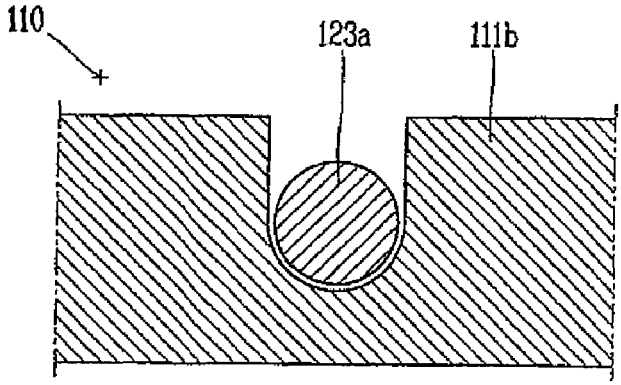
FIG. 7 shows a section taken along the line II-II in FIG. 5.

FIG. 5 shows an ice tray assembly for a refrigerator which is provided with dials rotating the ice trays in FIG. 1, FIG. 6 shows a section taken along the line I-I in FIG. 5 and FIG. 7 shows a section taken along the line II-II in FIG. 5.

With reference to FIGS. 5 through 7, the dials 140 may be provided to be connected with each of the plurality of ice trays 120 for rotating each of the plurality of trays 120.

Herein, shafts 123*a* and 123*b* may be provided at both sides of each ice tray 120 to be inserted into each support portion 111*a* and 111*b* provided at the case 110 for being rotatably fixed thereat.

Herein, the support portion 111*b* provided at a right side of each ice tray may be provided with a recess 112 so as for the shaft 123*b* of the ice tray 120 to be inserted into.

Meanwhile, the dials 140 may be coupled to the shaft 123*a* of each ice tray 120 which is inserted into a hole 111*h* formed at the support portion 111*a*. Accordingly, when a user rotates the dials 140, ice from the ice tray 120 may drop to the ice storage box 150 disposed the lower side of the case 110.

Herein, preferably a hand grip 141 may be provided at the dials 140 so as to allow the user to easily rotate the ice trays 120.

Meanwhile, dial grooves 134 concaved corresponding to a shape of the dial 140 may be formed at the body 132 of the water box.

Figure 8:
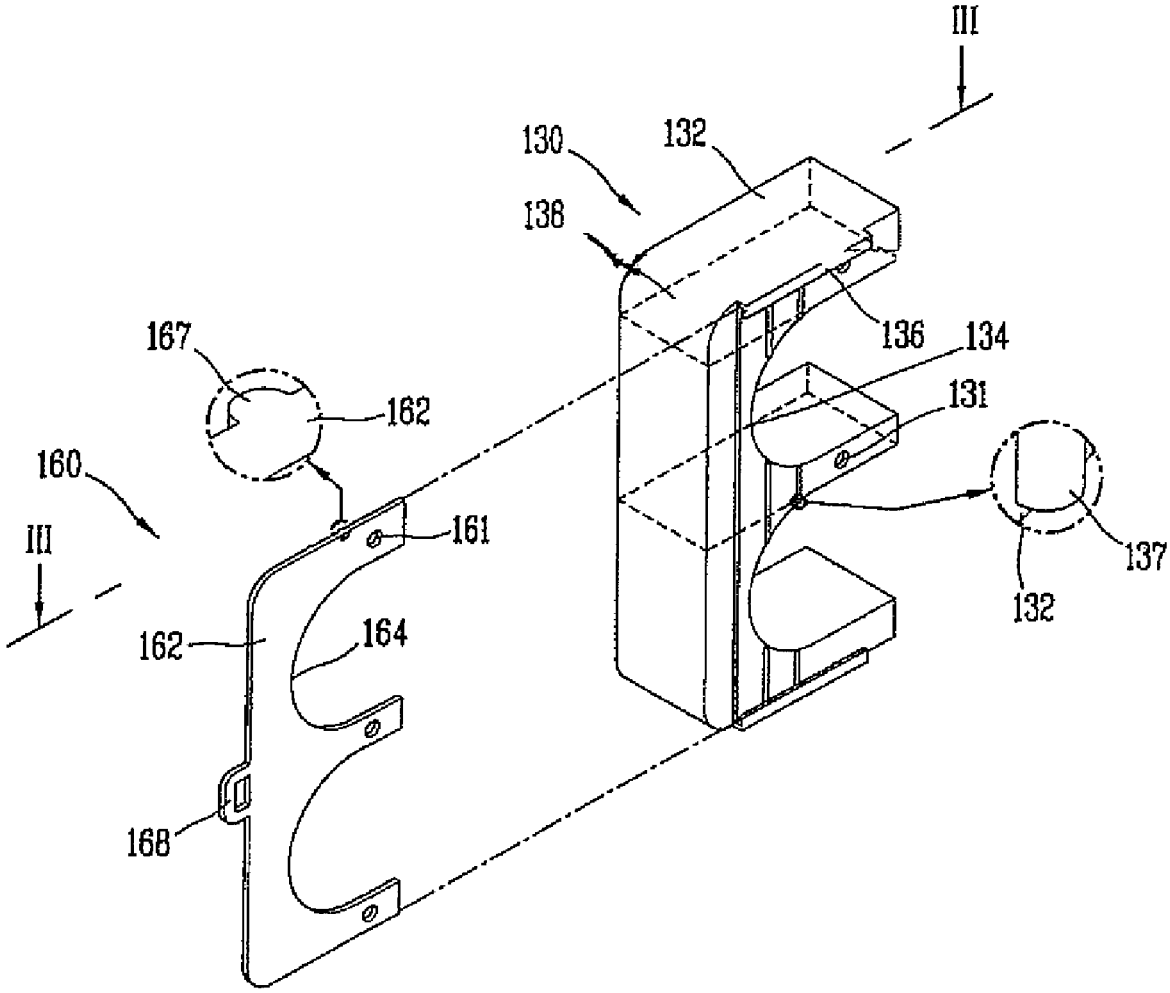
FIG. 8 shows a water box and a plate in accordance with the first embodiment of the present invention.
Figure 9A:
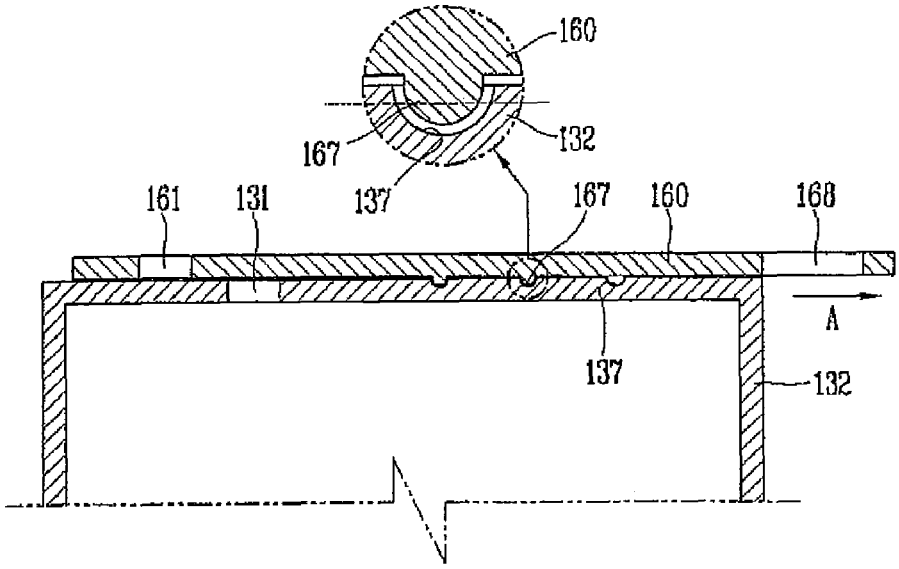
FIG. 9A shows a section taken along the line III-III in FIG. 8, which shows a state that a discharge hole of the water box is closed.
Figure 9B:
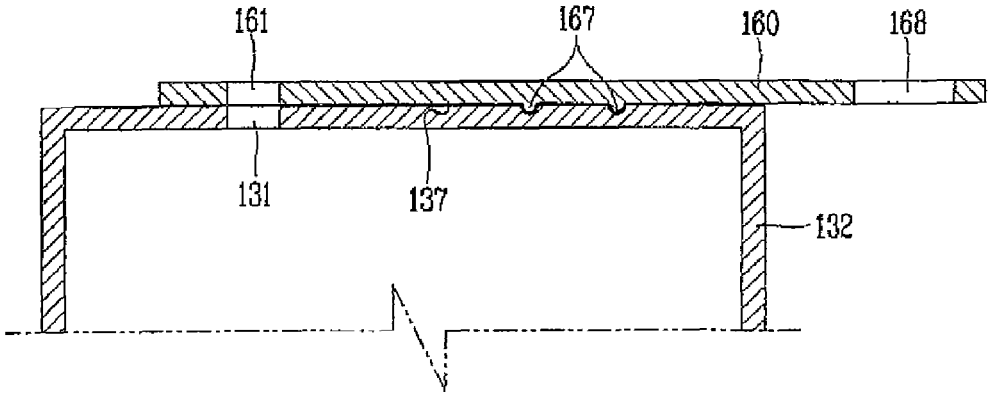
FIG. 9B shows a section taken along the line III-III in FIG. 8, which shows a state that the discharge hole of the water box is opened.

FIG. 8 shows a water box and a plate in accordance with the first embodiment of the present invention, and FIGS. 9A and 9B shows a section taken along the line III-III in FIG. 8, which shows opening/closing operation of discharge holes of the water box by a plate. FIG. 9A shows that the discharge hole of the water box is closed and FIG. 9B shows that the discharge hole of the water box is opened. Also, an arrow A in FIG. 9A indicates an operation direction of the plate.

With reference to FIGS. 8, 9A and 9B, the water box 130 may include the discharge holes 131, the body 132, the guide recess 133, the guide protrusion 135 and a partition 138 which is horizontally disposed inside of the body 132 for uniformly partitioning receiving space for storing water.

The plate 160 may include communicating holes 161 selectively communicated with the discharge holes 131 and a hand grip 168.

The body 132 may provide the receiving space for storing water, wherein the receiving space may be long formed in the vertical direction so as for the stored water to be supplied to the ice trays by pressure of the water. Further, the body 132 may be provided with the dial grooves 134 into which the plurality of dials are inserted so as for the dials not to be interfered with the body 132. Two dial grooves 134 may be formed at a left side of the body 132 in FIG. 8. That is, the body 132 may have two dials inserted thereinto and two discharge holes 131 for supplying water to two upper ice trays.

Meanwhile, two discharge holes 131 may be protrudingly extended in a horizontal direction of the left side for supplying water to two upper ice trays. In addition, preferably, the body 132 may be formed of a transparent material so as to watch the amount of water filled therein.

Further, the water box 130 may be provided with guides 136 provided at upper/lower ends of the body 132, respectively, and the plate 160 for opening/closing the discharge holes 430 may be inserted into the guides 136.

Herein, preferably, stopping protrusions 167 and stopping grooves 137 may be formed at a surface which the water box 130 and the plate 160 are contacted with each other in the vertical direction of the water box 130 to be corresponded to each other.

That is, the stopping grooves 137 may be formed at one surface of the water box 130 or the plate 160, and the stopping protrusions 167 may be formed at the other surface, wherein three stopping grooves 137 and two stopping protrusions 167 may be formed, preferably.

Meanwhile, the partition 138 may be disposed inside of the body 132 for uniformly partitioning the receiving space for storing water, in FIG. 8, partitioning the receiving space inside the body 132 into two parts, beneath the discharge holes 131 provided at the body 132. At this time, the partition 138 may be inclined downward to the discharge holes 131 so as to totally discharge water stored in the body 132.

The discharge holes 131 may be disposed at the lower end of the body 132 so as to totally discharge water stored in the body 132. Further, preferably, the plurality of discharge holes 131 may be protrudingly extended in the horizontal direction so as to be disposed at the upper side of each of the plurality of the ice trays which are multi-staired in the vertical direction.

The plate 160 may be provided at the water box 130 for opening/closing the discharge holes 131, and provided with the hand grip 168. Preferably, the plate 160 may be disposed at the surface which the discharge holes 131 are located, and have same shape as a longitudinal section of the body 132.

That is, preferably, when coupled in a state that the discharge opening 131 of the water box 130 is closed, the plate 160 may have the same shape as the dial grooves 134 of the water box.

Further, the plate 160 may close the discharge holes 131 when water is stored in the water box 130 and then draw the hand grip 168 in a direction of the arrow A in FIG. 9A when the water box 130 is fixed in the case, accordingly the discharge holes 131 may be opened for supplying water stored in the water box 130 to the ice trays.

Meanwhile, forming the stopping protrusions and stopping recesses on the surface of the plate in the vertical direction is same as described above.

Hereinafter, operation in accordance with the first embodiment of the present invention will be described.

After the water box 130 is filled with water through the plurality of discharge holes 131 provided at the water box 130, the plate 160 may be fitted into the body 132 of the water box 130 to close the plurality of discharge holes 131. At this time, water may be uniformly stored by the partition 138 provided at the water box 130.

Next, when the water box 130 is fitted into the case 100 and the hand grip 168 disposed at the plate 160 pulled, water stored in the water box 130 may be discharged outside of the plurality of discharge holes 131 provided at the water box 130 by water pressure. At the same time, the water may be uniformly supplied to the plurality of ice trays.

Hereinafter, an ice tray assembly for a refrigerator in accordance with a second embodiment of the present invention will be described with reference to FIGS. 10 and 11. Herein, description overlapped with that of the first embodiment will be omitted.

Figure 10:
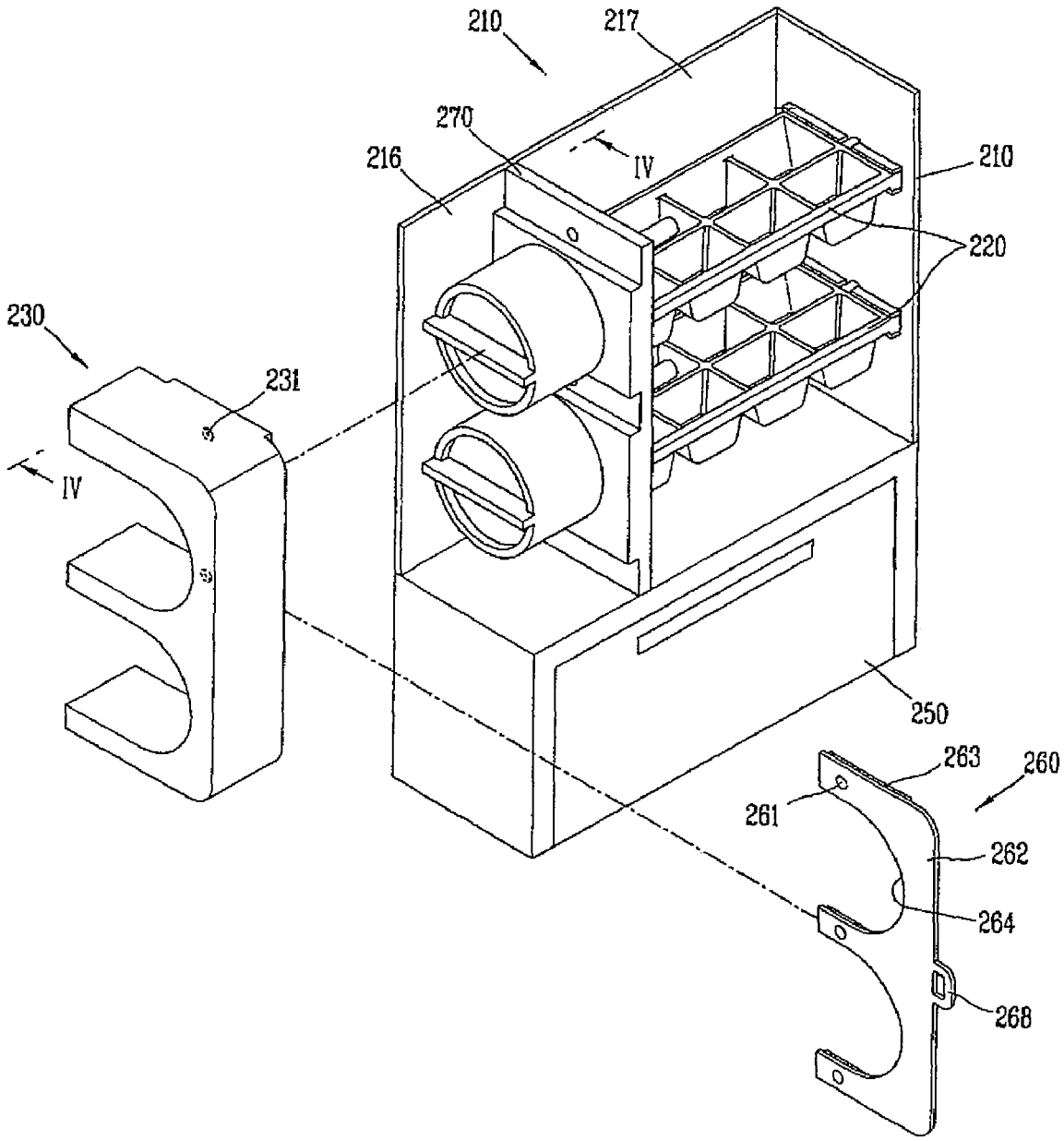
FIG. 10 shows an ice tray assembly for a refrigerator in accordance with a second embodiment of the present invention.
Figure 11:
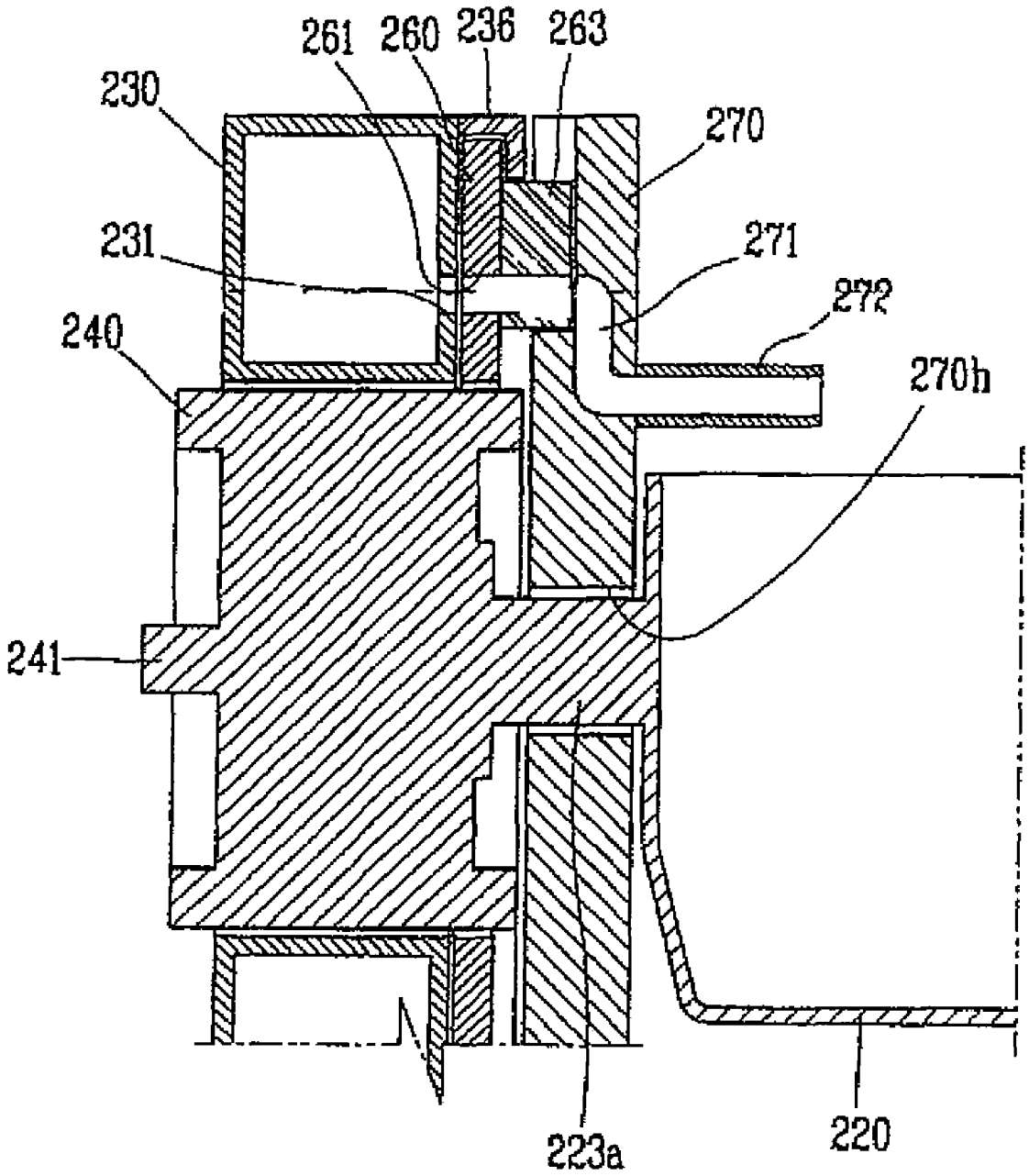
FIG. 11 shows a section taken along the line IV-IV in FIG. 10.

FIG. 10 shows an ice tray assembly for a refrigerator in accordance with the second embodiment, and FIG. 11 shows a section taken along the line IV-IV in FIG. 10.

With reference to FIGS. 10 and 11, the ice tray assembly for the refrigerator in accordance with the second embodiment of the present invention may include a case 210, ice trays 220 disposed in the case 210, a water box 230 disposed at a lateral surface of the ice trays 220 to supply water to the ice trays 220 and discharge holes 231 provided at the water box 230 to be corresponding to the number of the ice tray 220.

The case 210 may include a water discharging portion 216 for mounting the water box and an ice making portion 217 for mounting the ice trays. At this time, a partition 270 partitioning between the water discharging portion 216 and the ice making portion 217 may be provided at the case 210. A waterway 271 may be provided at the partition 270 for communicating the discharge holes 231 provided at the water box with the upper layer of the ice trays.

At this time, when the water box 230 is fitted into the water discharging portion 216, a guide recess 273 guiding the water box 230 may be provided at the partition 270 for allowing the discharge holes 231 and the waterway 271 to be communicated with each other, preferably.

Further, a hole 270*h* may be formed at the partition 270 for connecting dials 240 provided for a rotation of the ice tray 220 with a shaft 223*a* provided at the ice tray 220.

The ice trays 220 may be disposed in the case 210 for receiving water to make ice. Each of the plurality of the ice trays 220 may be multi-staired in the case 210 in the vertical direction. FIG. 10 illustrates one example that two ice trays 220 are multi-staired in the case 210 in the vertical direction.

The dials 240 may be disposed at the case 210 for rotating each of the plurality of ice trays 220 by being connected with each of the plurality of ice trays 220. The dials 240 may be connected with the shaft 223*a* of the ice tray 220, which is inserted into the hole 270*h* formed at the partition 270 so as to rotate the plurality of ice trays 220 multi-staired in the ice making portion 217 in the vertical direction. Further, preferably, the dials 240 may be provided with a hand grip 241 so as to allow the user to easily rotate the ice trays 220.

The water box 230 may be disposed in the case 210 to supply water to the plurality of ice trays 220. The water box 230 may be inserted from the front surface of the case 210 to be located at the lateral surface of the case 210. Herein, the water box can be inserted from the lateral surface of the case, but the former may be more preferable when considering efficiency of space.

The waterway 271 formed at the partition 270 may connect the plurality of discharge holes 231 provided at the water box 230 and the upper side of the plurality of the ice trays 220 for supplying water to each of the plurality of the ice trays 220 from the water box 230.

At this time, preferably, the waterway 271 may be inclined toward the ice trays 220 so as to totally discharge water to the ice trays 220.

Meanwhile, preferably, the ice tray assembly in accordance with the second embodiment of the present invention may be provided with an ice storage box 250 at a lower portion of the case 210 to be paralleled with the ice trays 220 in the vertical direction so as to receive ice dropped from the ice trays 220.

With such structure described above, the present invention may provide the ice tray assembly for a refrigerator which is capable of supplying water to the plurality of ice trays at once.

Further, in the present invention, the water box may be disposed at the lateral surface of the ice trays, accordingly, water can be easily supplied to the ice trays.

Further, the present invention may provide the ice tray assembly for a refrigerator which is capable of supplying uniform amount of water to each of the plurality of the ice trays.

Further, the present invention may provide the ice tray assembly for a refrigerator in which whole water in the water box is supplied to the plurality of ice trays.

Further, the present invention may provide the ice tray assembly which is capable of making uniform pieces of ice by filling the ice trays with the uniform amount of water.

Further, the present invention may provide the ice tray assembly which is capable of selectively separating ice from the plurality of ice trays by dials rotating each ice tray from outside thereof.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present inventive features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. An ice tray assembly for a refrigerator, comprising:

a case detachably coupled to a refrigerator door;

at least one ice tray detachably coupled to the case;

a water box detachably directly coupled to one side of the ice tray and configured to supply water to the ice tray, and having a water storage space for storing water to be supplied into the ice tray, the water box having a discharge hole formed at a side wall surface forming the water storage space; and a shut plate coupled to one side surface of the water box to be slidably linearly slidably retractable, wherein said shut plate comprises a connecting hole for selectively aligning with and therefor opening and closing the discharge hole of the water box.

2. The assembly of claim 1, further comprising a plurality of ice trays aligned in a longitudinal direction, wherein the water storage space of the water box is longitudinally divided in correspondence with the number of ice trays, and wherein a discharge hole is formed to be located at an upper side of each of the ice trays.

3. The assembly of claim 1, wherein the water box comprises a guide configured to allow the shut plate to be slidably detachably coupled to the water box.

4. The assembly of claim 1, wherein the water box comprises a stopping groove and the shut plate comprises a stopping protrusion corresponding to the stopping groove of the water box, so as to retain an introduction position of the shut plate.

5. The assembly of claim 1, wherein the ice tray is rotatably coupled to the case, and further comprising a dial for rotating the ice tray being provided at one end of the ice tray.

6. The assembly of claim 1, wherein the case and the water box comprise a guide protrusion and a guide recess, respectively, both corresponding to each other, such that the water box is detachably coupled to the case.

7. The assembly of claim 1, wherein the case comprises an integrally formed partition for dividing the ice tray and the water box, the partition having a waterway configured to be selectively communicated with the discharge hole of the water box by virtue of the shut plate.

8. The assembly of claim 7, wherein the waterway comprises an outlet and an inlet, the outlet being lower than the inlet.

9. The assembly of claim 8, wherein an extend-pipe portion is further provided at the outlet of the waterway so as to extend the waterway toward the ice tray.

* * * * *